US007165983B1

(12) United States Patent
Fasce et al.

(10) Patent No.: US 7,165,983 B1
(45) Date of Patent: Jan. 23, 2007

(54) ACCESS COVER CONFIGURED TO RECEIVE A TESTING DEVICE

(75) Inventors: Xavier Fasce, Verchaix (FR); Jerome A. Pratt, Round Rock, TX (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 11/297,281

(22) Filed: Dec. 8, 2005

(51) Int. Cl.
*H01R 13/44* (2006.01)

(52) U.S. Cl. ..... 439/136; 439/276; 439/936; 439/409

(58) Field of Classification Search ..... 439/409, 439/135, 136, 276, 936
See application file for complete search history.

(56) References Cited

U.S. PATENT DOCUMENTS

| | | | | |
|---|---|---|---|---|
| 3,617,983 | A | 11/1971 | Patton | |
| 3,702,456 | A | 11/1972 | Patton | |
| 4,017,140 | A | 4/1977 | Reavis, Jr. et al. | |
| 4,508,411 | A | 4/1985 | Hughes et al. | |
| 4,533,196 | A | 8/1985 | Forberg et al. | |
| 4,541,679 | A | 9/1985 | Fiedler et al. | |
| 4,815,988 | A | 3/1989 | Scherer | |
| 4,995,829 | A | 2/1991 | Geib et al. | |
| 5,149,281 | A * | 9/1992 | Hills et al. | 439/521 |
| 5,199,899 | A | 4/1993 | Ittah | |
| 5,281,163 | A | 1/1994 | Knox et al. | |
| 5,435,747 | A | 7/1995 | Franckx et al. | |
| 5,496,192 | A * | 3/1996 | Hower et al. | 439/409 |
| 5,549,489 | A | 8/1996 | Baggett et al. | |
| 5,556,296 | A | 9/1996 | Dussausse et al. | |
| 5,575,689 | A | 11/1996 | Baggett et al. | |
| 5,762,518 | A | 6/1998 | Tanigawa et al. | |
| 5,785,548 | A | 7/1998 | Capper et al. | |
| 5,797,759 | A | 8/1998 | Mattis et al. | |
| 5,967,826 | A | 10/1999 | Letailleur | |
| 6,015,312 | A | 1/2000 | Escane | |
| 6,056,584 | A | 5/2000 | Daoud | |
| 6,089,902 | A | 7/2000 | Daoud | |
| 6,099,343 | A | 8/2000 | Bonvallat et al. | |
| 6,152,760 | A | 11/2000 | Reeser | |
| 6,159,036 | A | 12/2000 | Daoud | |
| 6,193,556 | B1 | 2/2001 | Escane | |
| 6,254,420 | B1 | 7/2001 | Letailleur et al. | |
| 6,254,421 | B1 | 7/2001 | Denovich et al. | |

(Continued)

FOREIGN PATENT DOCUMENTS

| | | |
|---|---|---|
| DE | 33 13 654 A1 | 10/1984 |

(Continued)

OTHER PUBLICATIONS 3M 4500 Modular Terminating System, Technical Report, Oct. 1993, 20 pages, 3M Telecom and Visual Systems Group, Austin, Texas 78726.

*Primary Examiner*—Tho D. Ta
(74) *Attorney, Agent, or Firm*—John A. Burtis

(57) ABSTRACT

An access cover configured to pivotally connect to an insulation displacement connector (IDC) block includes a body and a releasable securing mechanism extending from the body. The body includes an opening configured to receive a testing device and a recess configured to receive an electrical conductor. The releasable securing mechanism is configured to engage with the IDC block to releaseably fix the access cover in a closed position.

18 Claims, 4 Drawing Sheets

U.S. PATENT DOCUMENTS

| | | | | |
|---|---|---|---|---|
| 6,283,785 | B1 * | 9/2001 | Daoud | 439/409 |
| 6,346,004 | B1 * | 2/2002 | Daoud | 439/395 |
| 6,406,324 | B1 | 6/2002 | Duesterhoeft et al. | |
| 6,582,247 | B2 | 6/2003 | Siemon | |
| 6,604,956 | B2 | 8/2003 | Ruiz et al. | |
| 6,676,430 | B1 | 1/2004 | Conorich | |
| 6,811,430 | B1 * | 11/2004 | Carrico et al. | 439/409 |
| 2003/0049961 | A1 | 3/2003 | Tricaud et al. | |
| 2003/0156389 | A1 | 8/2003 | Busse et al. | |

FOREIGN PATENT DOCUMENTS

| | | | |
|---|---|---|---|
| DE | 43 19 565 | C1 | 7/1994 |
| EP | 0 073 740 | B1 | 6/1985 |
| EP | 0 271 413 | B1 | 5/1992 |
| EP | 0 718 915 | B1 | 7/1997 |
| FR | 2 730 096 | A1 | 8/1996 |
| GB | 2 129 628 | A | 5/1984 |
| GB | 2 149 231 | A | 6/1985 |
| GB | 2 293 696 | A | 4/1996 |
| WO | WO 99/04454 | | 1/1999 |
| WO | WO 99/04455 | | 1/1999 |
| WO | WO 01/57957 | A1 | 8/2001 |

* cited by examiner

ACCESS COVER CONFIGURED TO RECEIVE A TESTING DEVICE

FIELD

The present invention relates to an apparatus for use in connection with an insulation displacement connector block ("IDC block"). More particularly, the present invention relates to an access cover that is configured to connect to an IDC block, where the access cover includes an opening configured to receive a testing device.

BACKGROUND

In a telecommunications context, some connector blocks are connected to electrical conductors (e.g., cables) that feed subscribers while other connector blocks are connected to electrical conductors ("conductors") that are fed from a service provider center. To make the electrical connection between the subscriber block and the service provider block, a conductor (e.g., a jumper wire) is inserted in each connector block to complete the electrical circuit. Typically the jumper wire can be connected, disconnected, and reconnected several times as the subscriber's needs change.

The basic components of a connector block typically include a plurality of housing assemblies, where each housing assembly includes a housing, an insulation displacement connector (IDC) element disposed within the housing, and an access cover connected to the housing. The IDC element is used to make an electrical connection with a conductor that is partially disposed within the housing in order to complete the electrical circuit between the subscriber block and the service provider block. The IDC element displaces the insulation from a portion of the conductor when the conductor is inserted into an insulation displacement slot within the IDC element. An electrical contact is then made between the conductive surface of the IDC element and a conductive core of the electrical conductor.

The IDC element (a "first" IDC element) is typically electrically connected to a corresponding IDC element (a "second" IDC element) within the connector block. For example, the first IDC element may be electrically connected to a jumper wire that electrically connects to another connector block, while the second IDC element may be electrically connected to a conductor that is connected to a service provider or a subscriber.

In order to verify that an electrical connection has been made between the first and second IDC elements (which may then be used to verify that a circuit has been completed between a subscriber and service provider), as well as to troubleshoot the circuit, a testing device (such as a test probe) may be inserted in the IDC block. Each housing assembly of the IDC block typically includes a slot configured to receive such a testing device. After the testing device is introduced into the testing device slot, the testing device breaks a connection between the first IDC element and the second IDC element. This enables the testing device to electrically isolate the circuit in order to test for problems in two ways. First, the testing device may measure the current (or other property of interest) in the jumper wire. Second, the testing device may measure the current (or other property of interest) in the conductor that is electrically connected to the subscriber or the service provider. These tests can help isolate a problem with the circuit.

When a connector block is used in the telecommunications context, a plurality of connector blocks is typically mounted in a central location, such as a telecommunications closet, an outdoor cabinet, an aerial terminal or closure or another common use application. It is desirable to minimize the amount of time that it takes to test a circuit. With many IDC block designs, each access cover must be individually opened in order to access the testing device slot in the housing. The present invention addresses this potentially time-consuming process.

BRIEF SUMMARY

In a first aspect, the present invention provides an access cover configured to connect to an insulation displacement connector (IDC) block. The access cover comprises a body configured to pivotally connect to the IDC block and a releasable securing mechanism extending from the body. The body comprises an opening configured to receive a testing device. The releasable securing mechanism is configured to engage with the IDC block to releaseably fix the access cover in a closed position.

In a second aspect, the present invention provides an insulation displacement connector (IDC) block comprising a first housing including a first IDC element and a first testing device slot, a second housing including a second IDC element and a second testing device slot, a first access cover movable between a first open position and a first closed position, and a second access cover movable between a second open position and a second closed position. The first access cover comprises a first back portion pivotally connected to the first housing and including a first recess configured to receive a first electrical conductor, a first cover portion adjacent to the first back portion and including a first opening configured to receive a testing device, and a first releasable securing mechanism extending from the first cover portion and configured to engage with the IDC block to releaseably fix the first access cover in the first closed position. The first testing device slot is accessible through the first opening in the first cover portion when the first access cover is in the first closed position. The second access cover comprises a second back portion pivotally connected to the second housing and including a second recess configured to receive a second electrical conductor, a second cover portion adjacent to the second back portion and including a second opening configured to receive a testing device, and a second releasable securing mechanism extending from the second cover portion and configured to engage with the IDC block to releaseably fix the second access cover in the second closed position. The second testing device slot is accessible through the second opening in the second cover portion when the second access cover is in the second closed position.

In a third aspect, the present invention provides a method of testing an electrical connection made with an IDC block assembly, which includes an IDC block comprising a first IDC element, a second IDC element electrically connected to the first IDC element, and a testing device slot providing access to a point of electrical contact between the first and second IDC elements. The IDC block assembly further includes an access cover pivotally connected to the IDC block, where the access cover comprises a cover portion and a back portion, the cover portion of the access cover including a test opening aligned with and providing access to the testing device slot. The method comprises introducing a testing device into the test opening in the cover portion of the access cover, thereby accessing the testing device slot, and measuring a property of the electrical connection.

The above summary is not intended to describe each disclosed embodiment or every implementation of the present invention. The figures and the detailed description that follow more particularly exemplify illustrative embodiments.

BRIEF DESCRIPTION OF THE DRAWINGS

The present invention will be further explained with reference to the drawing figures listed below, where like structure is referenced by like numerals throughout the several views.

While the above-identified figures set forth an exemplary embodiment of the present invention, other embodiments are also within the invention. In all cases, this disclosure presents the invention by way of representation and not limitation. It should be understood that numerous other modifications and embodiments can be devised by those skilled in the art, which fall within the scope and spirit of the principles of the invention.

DETAILED DESCRIPTION

The present invention is an access cover configured to connect to an insulation displacement connector (IDC) block, where the access cover includes an opening for receiving a testing device (a "test opening").

Figure 1:
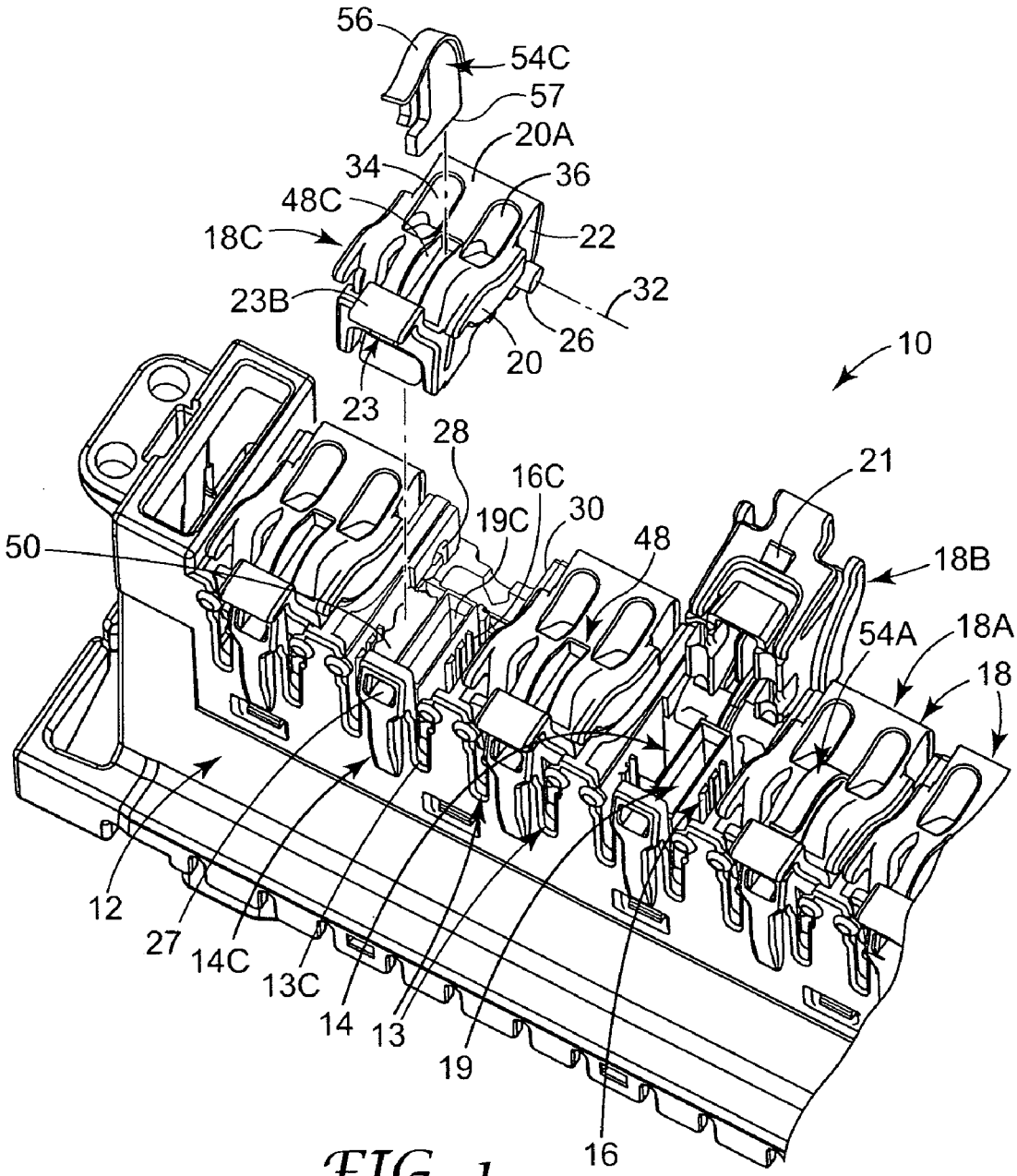
FIG. 1 is a partial exploded perspective view an electrical connector assembly, which includes an insulation displacement connector block and a plurality of access covers in accordance with an embodiment of the present invention, where one access cover 18C is aligned to connect to a housing 14C.

FIG. 1 is a partial exploded perspective view of electrical connector assembly 10 of the present invention, which includes IDC block 12 with a plurality of housings 14 and a plurality of IDC elements 16, and a plurality of access covers 18 in accordance with an embodiment of the present invention. An IDC element 16 is disposed within each housing 14. Each of the access covers 18 is independently connected to a housing 14 of IDC block 12. Together each access cover 18 and its respective housing 14 form a housing assembly.

Access cover 18A is connected to housing 14A, access cover 18B is connected to housing 14B, and access cover 18C is aligned to connect with housing 14C. Access covers 18A, 18B, and 18C are each substantially similar in structure and are each movable between an open position (e.g., access cover 18B) and a closed position (e.g., access cover 18A). The description of the structure of access cover 18C is representative of the structure of each of the access covers 18, and the description of the structure of housing 14C and IDC element 16C is representative of the structure of each of the housings 14 and IDC elements 16, respectively.

Access cover 18C includes cover portion 20, back portion 22, and releasable securing mechanism 23, which extends from cover portion 20. Extending laterally from back portion 22 is first pivot projection 24 (shown in FIG. 5) and second pivot projection 26. Pivot projections 24 and 26 are configured to engage with apertures 28 and 30 within housing 14C of IDC block 12 to connect access cover 18C to housing 14C. After access cover 18C is connected to housing 14C, access cover 18C is free to rotate about axis 32.

Latching mechanism 23 of access cover 18C includes a latching member (not shown) and release member 23B. The latching member 23A is not shown in FIG. 1, but it is configured similarly to latching member 21 of access cover 18B. The latching member 23A protrudes from access cover 18C and is configured to engage with a surface within opening 27 in housing 14C in order to fix access cover 18C in a closed position. In some configurations of IDC block 12, it is desirable for access cover 18C to remain in its closed position after an electrical conductor is electrically connected to IDC element 16C disposed in housing 14C. The closed position helps to ensure the electrical conductor remains in electrical contact with IDC element 16C and/or helps prevent environmental hazards from being introduced into housing 14C of IDC block 12.

Release member 23B is biased toward opening 27 in housing 14C and may be flexed away from opening 27 in order to disengage latching member 23A from the surface within opening 27. Disengaging latching member 23A from the surface within opening 27 enables access cover 18C to be moved from its closed position to its open position. In alternate embodiments, access cover 18C includes other suitable releasable securing mechanisms.

Access cover 18C is an integral unit, where cover 20 portion, back portion 22, and releasable securing mechanism 23 are formed of a single piece of material. In an alternate embodiment, access cover 18C is formed of multiple pieces that are attached using a suitable means, such as an adhesive or a mechanical attachment means. Access cover 18C may be constructed of any suitable material, including an engineering plastic such as, but not limited to: Ultem® 1100 a polyether imide resin available from GE Plastics of Pittsfield, Mass.; Valox® 562 SEO a polybutylene terephthalate (PBT) resin flame retardant, 30% glass fiber reinforced available from GE Plastics of Pittsfield, Mass.; IXEF.® 1601 a polyarylamide resin, flame retardant, 30% glass fiber reinforced grade available from Solvay Advanced Polymers, LLC of Alpharetta, Ga.; or IXEF.® 1641 a polyarylamide resin, flame retardant, 60% glass fiber reinforced grade available from Solvay Advanced Polymers, LLC of Alpharetta, Ga.

In some embodiments, access cover 18C is removably connected to housing 14C, as described in U.S. patent application Ser. No. 11/296,968, entitled "CAP CONFIGURED TO ATTACH TO AN INSULATION DISPLACEMENT CONNECTOR BLOCK", and filed on even date herewith. In some embodiments where access cover 18C is removably connected to housing 14C, access cover 18C is formed of a suitably flexible material, such as, but not limited to, acetals, acrylics, acetates, cellulose derivatives, fluoropolymers, liquid crystal polymers, polyamides, polyimides, polyarylsulfones, polybenzimidazoles polycarbonates, polyolefins, polyesters, polyethers, polyketones, polyetheretherketones, polyetherimides, polyethersulfones, polyphenylether, polyphenylsulfone, polyurethane, phenolics, silicones, and rubbers.

Extending into back portion 22 of access cover 18C are first recess 34 and second recess 36. In one embodiment, first recess 34 and second recess 36 are each through holes extending through back portion 22. In another embodiment, first recess 34 and second recess 36 each extend partially through back portion 22. Although first and second recesses 34 and 36 are shown in FIG. 1 as parallel recesses through back portion 22, in an alternate embodiment, first and second recesses 34 and 36 are not parallel to one another. First and second recesses 34 and 36 are each configured to receive an electrical conductor that is introduced into housing 14C.

In order to electrically connect an electrical conductor to IDC element 16C of housing 14C, the conductor is aligned with IDC element 16C by introducing the conductor into conductor passage 13C of housing 14C and into recess 36 of access cover 18C (when access cover 18C is in an open position). Access cover 18C is then closed (e.g., access cover 18A). As access cover 18C is closed, a wire stuffer (shown in FIG. 5) pushes the conductor into IDC element 16C and IDC element 16C displaces insulation surrounding a conductive core of the conductor. When contact between IDC element 16C and the conductor core of the conductor is established, IDC element 16C and the conductor core are electrically connected. The electrical connection between IDC element 16C and the conductor typically completes an electrical circuit between a subscriber block and a service provider block. After the circuit is completed, the circuit may be tested for various reasons. For example, if a subscriber experiences service problems, the service provider may test the circuit to troubleshoot the problem.

Figure 2:
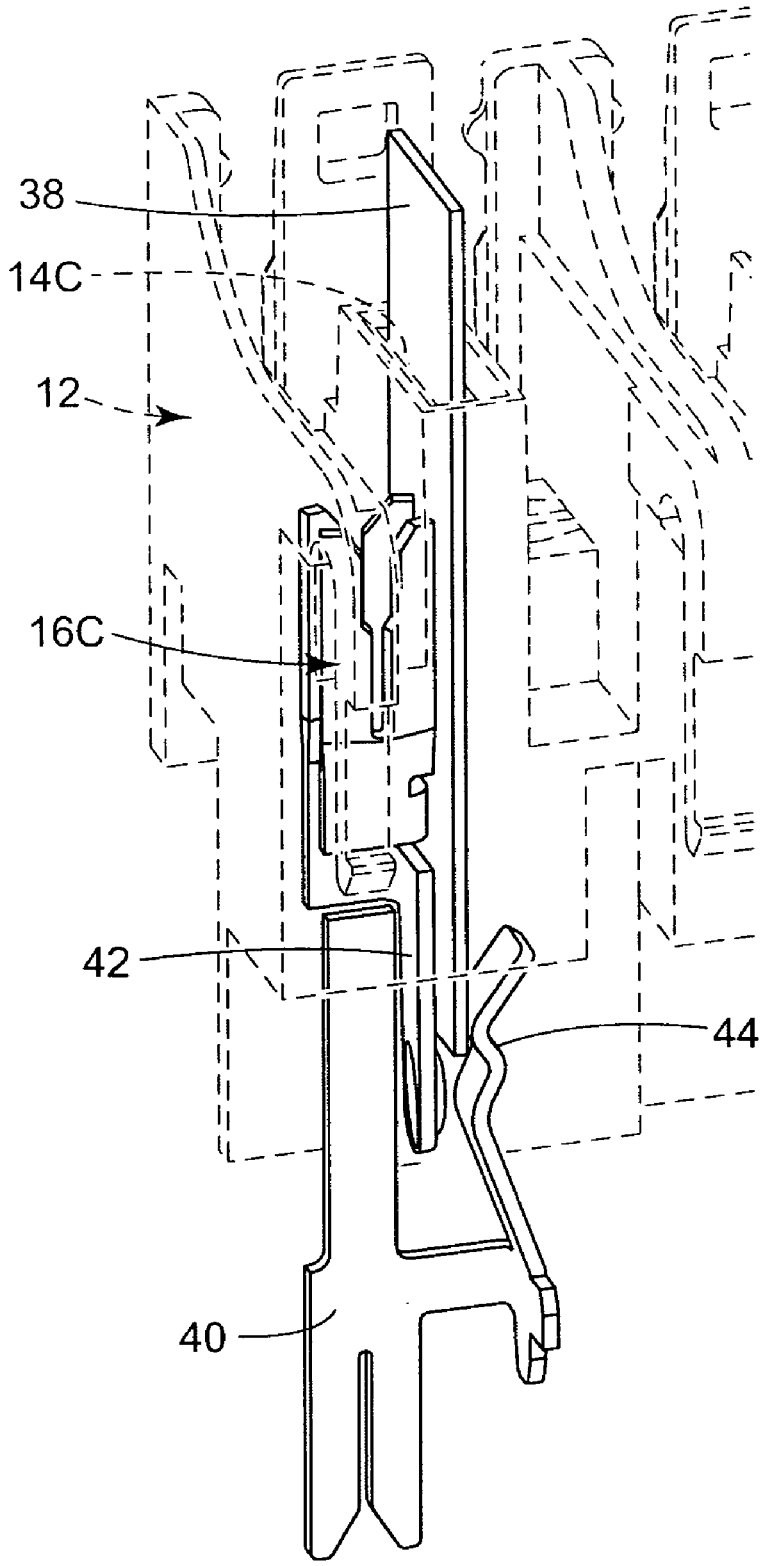
FIG. 2 is a perspective view through the insulation displacement connector block of FIG. 1 (shown in phantom) illustrating a test probe inserted between a tail of the a first insulation displacement connector element and a tail of a second insulation displacement connector element.

In order to test an electrical connection made within housing 14C, a testing device may be introduced into testing device slot 19C in housing 14C. Each housing 14 includes a corresponding testing device slot 19. An example of a testing process is shown in FIG. 2, which is a perspective view through IDC block 12 (shown in phantom). FIG. 2 illustrates testing device 38 breaking an electrical connection between first IDC element 16C and second IDC element 40. Testing device 38 is a schematic representation of a testing device probe, and exact details of testing device 38 have been removed for clarity of illustration.

Tail 42 of IDC element 16C contacts tail 44 of IDC element 40, thereby electrically connecting a first conductor connected to IDC element 16C with a second conductor connected to second IDC element 40. Test probe 38 is inserted into test probe slot 19C, and breaks the contact between tail 42 of IDC element 16C and tail 44 of second IDC element 40. Breaking the electrical connection between IDC elements 16C and 40 using test probe 38, as is known in the art, allows a tester to electrically isolate a circuit on both sides of test probe 38 at IDC tails 42 and 44, and test for problems. Electrically isolating the circuit breaks the circuit into first and second parts, where IDC element 16C is in the first part of the circuit and IDC element 40 is in the second part of the circuit. A property (e.g., current, voltage) of the first and second circuits may then be measured separately using test probe 38. This may, for example, help a user troubleshoot a problem with the circuit.

In existing access cover designs, an access cover must be opened or removed from the housing 14C in order to access testing device slot 19C. This is a potentially time-consuming task for a user who needs to test hundreds of circuits, and thus, open or remove hundreds of access covers. Furthermore, if the access cover is completely detached from the housing, the potential for the access cover to be misplaced is presented. An access cover in accordance with the present invention addresses these issues.

Returning now to FIG. 1, test openings 48 in each of the access covers 18 of the present invention eliminate the need for access covers 18 to be opened or removed in order to access the respective testing device slot 19 disposed within the respective housing 14. Each testing opening 48 is aligned with the respective testing device slot 19 when the access cover 18 is in the closed position. For example, cover portion 20 of access cover 18C includes test opening 48C, which is aligned with testing device slot 19C when access cover 18C is in its closed position. In one particular embodiment, test opening 48C is shaped and sized similarly to testing device slot 19C so that test opening 48C and testing device slot 19C are configured to receive identical testing devices. In an alternate embodiment, test opening 48C is located in back portion 22 of access cover 18C.

Figure 3:
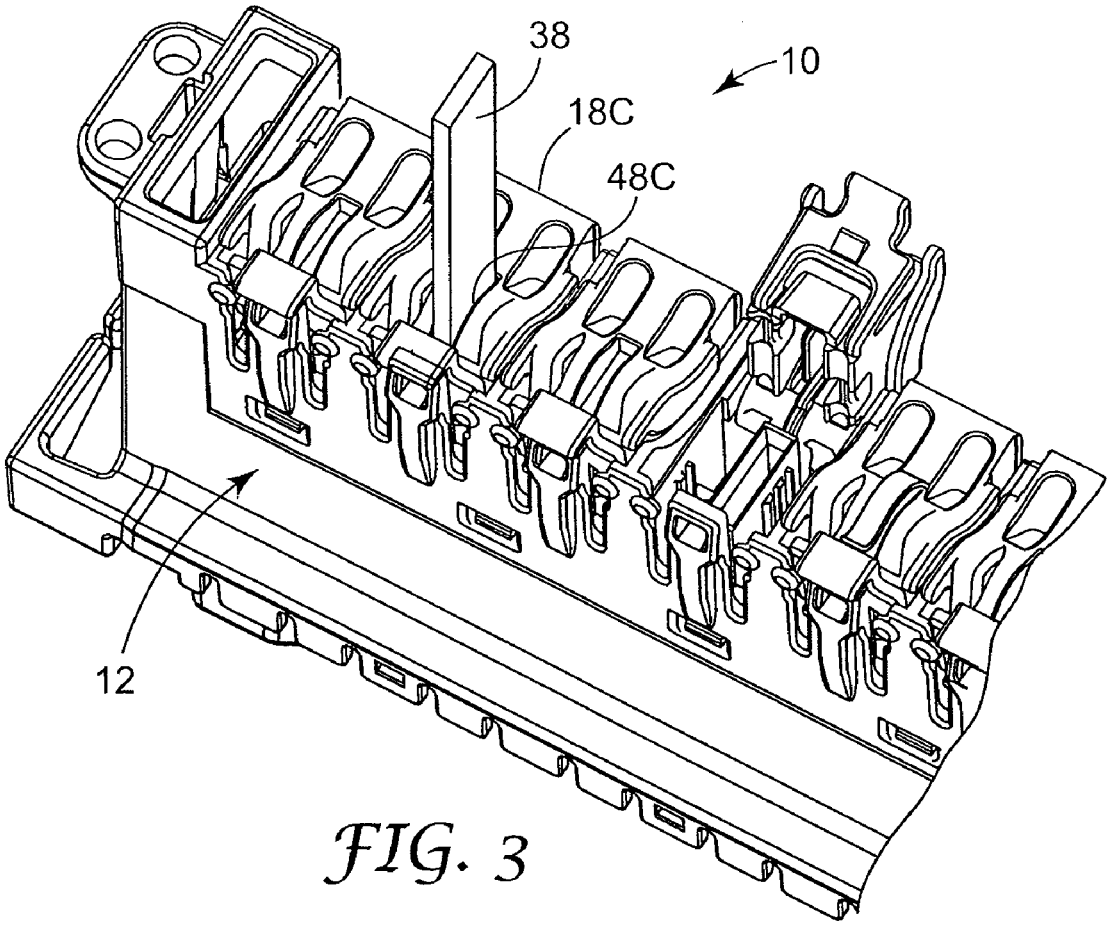
FIG. 3 is a perspective view of an electrical connector assembly, where a testing device is inserted into an testing opening in an access cover.

By introducing testing device 38 (shown in FIG. 2) into test opening 48C in access cover 18C, testing device 38 is aligned with, and may be inserted into, testing device slot 19C of housing 14C without having to open or remove access cover 18C. In this way, test opening 48C in access cover 18C of the present invention streamlines a testing process. FIG. 3 illustrates how testing device 38 is inserted into test opening 48C of access cover 18C.

FIG. 3 shows connector assembly 10 after access cover 18C has been connected to IDC block 12. Testing device 38 is inserted into test opening 48C of access cover 18C and extends into testing device slot 19C (shown in FIG. 1) in order to test a circuit completed by IDC element 16C (shown in FIG. 1), as discussed above in reference to FIG. 2. As FIG. 3 further illustrates, a user no longer needs to open access cover 18C in order to access testing device slot 19C when access cover 18C of the present invention is incorporated into connector assembly 10.

Test openings 48 in each of access covers 18 of the present invention may be especially useful for testing multiple circuits at once with a testing device including multiple probes. For example, if IDC block 12 includes ten access covers 18 corresponding to ten circuits, a testing device including ten probes for testing ten circuits at a time may be employed. Rather than opening each of the ten access covers 18 prior to inserting the testing device into testing device slots 19, and then closing each access cover 18 after testing the circuits, access covers 18 of the present invention permit a user to insert the multi-probe testing device into testing device slots 19 without having to open multiple access covers 18. The user is able to directly insert the multi-probe testing device into test openings 48 in each of the access covers 18, which provide direct access to testing device slots 19.

Returning again to FIG. 1, gel or other sealant material 50 may be added to housing 14C after the conductor is connected to IDC element 16C and prior to the closure of access cover 18C in order to create a moisture seal within housing 14C. Sealant material 50 also acts as a barrier to help prevent moisture and other environmental debris from entering housing 14C through opening 48C. Suitable sealant materials include greases and gels, such as, but not limited to RTV® 6186 mixed in an A to B ratio of 1.00 to 0.95, available from GE Silicones of Waterford, N.Y.

Gels can be characterized as sealing materials containing a three-dimensional network and having finite elongation properties, which allow them to maintain contact with the elements and volumes they are intended to protect. Suitable gels that can be used as sealant material 50 for housing 14C may include formulations which contain one or more of the following: (1) plasticized thermoplastic elastomers such as oil-swollen Kraton triblock polymers; (2) crosslinked silicones including silicone oil-diluted polymers formed by crosslinking reactions such as vinyl silanes, and possibly other modified siloxane polymers such as silanes, or nitrogen, halogen, or sulfur derivatives; (3) oil-swollen crosslinked polyurethanes or ureas, typically made from isocyanates and alcohols or amines; (4) oil swollen polyesters, typically made from acid anhydrides and alcohols. Other gels are also possible. Other ingredients such as stabilizers, antioxidants, UV absorbers, colorants, etc. can be added to provide additional functionality if desired.

Useful gels have ball penetrometer readings of between 15 grams and 54 grams when taken with a 0.25-inch diameter steel ball and a speed of 2 millimeters/second to a depth of 4 millimeters in a sample contained in a cup such as described in ASTM D217 (3 inches diameter and 2.5 inches tall cylinder filled to top). Further, they will have an elongation as measured by ASTM D412 and D638C of at least 160%, and more preferred at least 360%. Also, these materials will have a cohesive strength, which exceeds the adhesive strength of an exposed surface of the gel to itself or a similar gel. Representative formulations include gels made from 3–15 parts Kraton G1652 and 90 parts petroleum oil, optionally with antioxidants to slow decomposition during compounding and dispensing.

In addition to using sealant material 50 as a moisture/environmental debris barrier, in one particular embodiment of the present invention, access cover 18C includes cap 54C that covers opening 48. Each access cover 18 also includes a similar cap. In FIG. 1, cap 54A covers opening 48A in access cover 18A, while cap 54C is aligned to attach to access cover 18C. A description of cap 54C is representative of each one of caps 54. Cap 54C is configured to fit within opening 48C and helps prevent moisture and environmental debris from entering housing 14C through opening 48C. Top portion 56 of cap 54C and top portion 20A of cover portion 20 of access cover 18C have similar contours. When cap 54C is positioned within opening 48C, cap 54C does not protrude a significant distance from top portion 20A of cover portion 20. However, cap 54C protrudes enough for a user to grasp top portion 56 of cap 54C (either with fingers or a tool) in order to remove cap 54C from opening 48C. In one embodiment, cap 54C is connected to access cover 18C by a pivotal connection or another suitable connecting means.

A sealant material may be disposed on underside 57 of cap 54C in order to further seal opening 48C, as well as to introduce more sealant material into housing 14C. When cap 54C is removed from opening 48C, sealant material 50 may inadvertently be removed from housing 14C. The sealant material on underside 57 of cap 54C helps to reintroduce sealant material into housing 14C. In order to help decrease the amount of time it takes to open each cap 54 prior to a testing process, multiple caps 54 may be integrated into one unit, as shown in FIG. 4.

Figure 4:
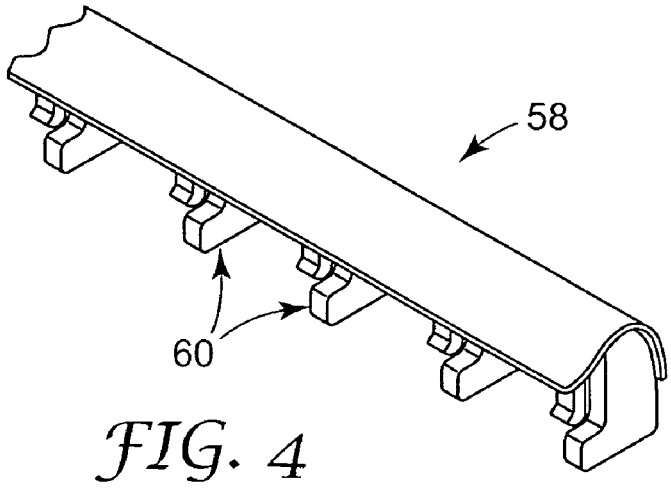
FIG. 4 is a perspective view of a multi-cap apparatus that includes a plurality of protrusions configured to cover the test openings in the access covers of FIG. 1.

FIG. 4 is a perspective view of an embodiment of multi-cap apparatus 58, which includes a plurality of protrusions 60 that are configured to be received in openings 48 of access covers 18. Essentially, protrusions 60 form multiple caps that are connected to form apparatus 58. Each of these protrusions 60 corresponds to at least one access cover 18 and covers opening 48 in the respective access cover 18, just as cap 54C covered opening 48C in cover portion 20 of access cover 18C. In order to access testing device slots 19 within each of the housings 14 of IDC block 12, a user only needs to remove apparatus 58, rather than removing multiple caps 54. This may help streamline the testing process. As with cap 54C, a sealant material may be applied to each of the protrusions 60.

Figure 5:
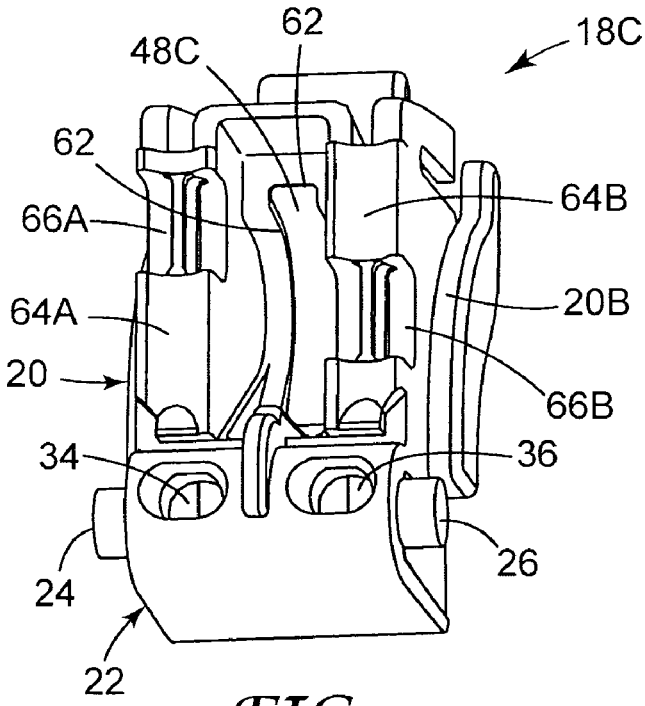
FIG. 5 is a perspective view of an underside of an access cover, which includes a back portion and a cover portion, the cover portion including a test opening.

FIG. 5 is a perspective view of underside 20A of cover portion 20 of access cover 18C. Underside 20A of cover portion 20 the side of cover portion 20 that is closest to housing 14C when access cover 18C is connected to housing 14C. Underside 20B of cover portion 20 is positioned on an opposite side of cover portion 20 from top portion 20A (shown in FIG. 1). As FIG. 5 shows, test opening 48C in cover portion 20 extends through cover portion 20, allowing a testing device inserted from top portion 20A (shown in FIG. 1) of cover portion 20 to extend through to underside 20B of cover portion 20. After access cover 18C is connected to housing 14C and is placed in its closed position, a user may insert a testing device into opening 48C in order to access testing device slot 19C (shown in FIG. 1) in housing 14C.

Sidewalls 62 of opening 48C are configured to enclose testing device slot 19C when access cover 18C is in its closed position. That is, when access cover 18C is in its closed position, only testing device slot 19C in housing 14C is accessible through opening 48C because sidewalls 62 block off access to other portions of housing 14C, including IDC element 16C disposed within housing 14C. In this way, sidewalls 62 help prevent environmental debris and moisture from entering the other portions of housing 14C through opening 48C. Sidewalls 62 of opening 48C also help guide the testing device into testing device slot 19C in housing 14C by providing a single path through which the testing device may move. In alternate embodiments, sidewalls 62 are configured to permit access to other portions of housing 14C, including IDC element 16C.

Underside 20B of cover portion 20 of access cover 18C includes wire huggers 64A and 64B and wire stuffers 66A and 66B. Wire hugger 64A is configured to engage an upper surface of a first electrical conductor that is introduced into housing 14C and recess 34 and wire hugger 64B is configured to engage an upper surface of a second electrical conductor that is introduced into housing 14C and recess 36. Wire stuffer 66A is configured to push the first electrical conductor into a first IDC element (e.g., IDC element 16C) disposed within housing 14C, while wire stuffer 66B is configured to push the second electrical conductor into a second IDC element disposed within housing 14C. A more detailed description of wire huggers 64A and 64B, and wire stuffers 66A and 66B can be found in U.S. patent application Ser. No. 10/941,441, entitled "CONNECTOR ASSEMBLY FOR HOUSING INSULATION DISPLACEMENT ELEMENTS", and filed on Sep. 15, 2004, which is hereby incorporated by reference. In an alternative embodiment, wire huggers 64A and 64B and wire stuffers 66A and 66B are absent from access cover 18C.

First and second pivot projections 24 and 26, respectively, extend laterally from back portion 22. As previously described, pivot projections 24 and 26 are configured to engage with apertures 28 and 30, respectively, in housing 14C in order to pivotally connect access cover 18C to housing 14C.

Figure 6:
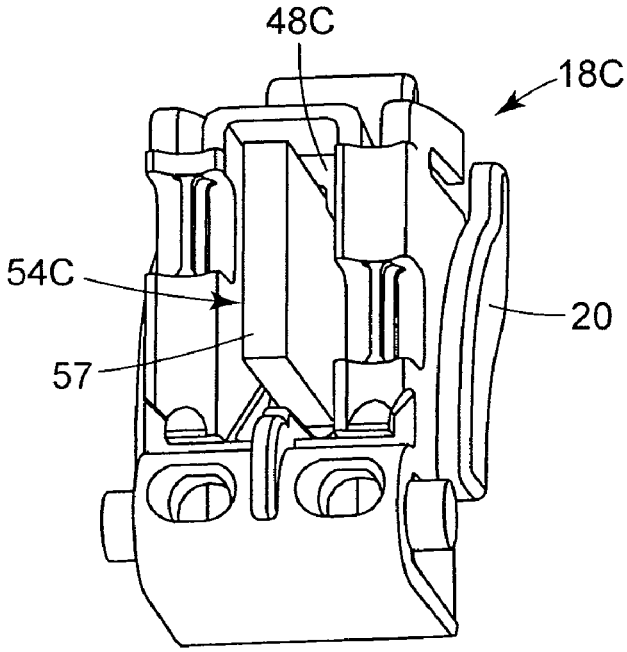
FIG. 6 is a perspective view of the underside of the access cover of FIG. 5, where a cap is positioned within the test opening in the cover portion.

FIG. 6 is a perspective view of an underside of access cover 18C, where cap 54C is positioned within opening 48C in cover portion 20. Cap 54C and opening 48C are similarly shaped, which allows cap 54C to fit snugly within opening 48C. Underside 57 of cap 54C extends past opening 48C and partially enters testing device slot 19C when access cover 18C is connected to housing 14C and is in its closed position. Underside 57 of cap 54C, therefore, acts as a cover for testing device slot 19C.

The depiction of IDC block 12 in FIG. 1 is used for illustrative purposes and is not intended to limit the present invention in any way. An access cover of the present invention may be incorporated into any suitable connector block that includes a testing device slot. Examples of suitable connector blocks to which an access cover of the present invention may be connected are described in U.S. patent application Ser. No. 10/941,506, entitled "INSULATION-DISPLACEMENT SYSTEM FOR TWO ELECTRICAL CONNECTORS", filed on Sep. 15, 2004, U.S. patent application Ser. No. 10/941,441, entitled "CONNECTOR ASSEMBLY FOR HOUSING INSULATION DISPLACEMENT ELEMENTS", filed on Sep. 15, 2004, and U.S. patent application Ser. No. 10/941,441, entitled "CONNECTOR ASSEMBLY FOR HOUSING INSULATION DISPLACEMENT ELEMENTS", filed on even date herewith.

Although the present invention has been described with reference to preferred embodiments, workers skilled in the art will recognize that changes may be made in form and detail without departing from the spirit and scope of the invention.

What is claimed is:

1. An access cover configured to connect to an insulation displacement connector (IDC) block, the access cover comprising:

a body configured to pivotally connect to the IDC block and comprising an opening configured to receive a testing device capable of breaking the circuit between at least two elements of an IDC within the block; and a releasable securing mechanism extending from the body, wherein the releasable securing mechanism is configured to engage with the IDC block to releaseably fix the access cover in a closed position.

2. The access cover of claim 1 wherein the access cover is at least partially formed of a material selected from a group consisting of a polyether imide resin; a polybutylene terephthalate (PBT) resin flame retardant, 30% glass fiber reinforced material; a polyarylamide resin, flame retardant, 30% glass fiber reinforced material; and a polyarylamide resin, flame retardant, 60% glass fiber reinforced material.

3. The access cover of claim 1 wherein the body comprises:

a cover portion, wherein the opening configured to receive the testing device is located in the cover portion and the releasable securing mechanism extends from the cover portion; and a back portion adjacent to the cover portion and comprising a recess configured to receive an electrical conductor.

4. The access cover of claim 3 wherein the cover portion, back portion, and releasable securing mechanism are an integral unit.

5. The access cover of claim 3 further comprising:

a guide on the cover portion aligned to engage the electrical conductor when the electrical conductor is introduced into the recess in the back portion of the access cover; and a protrusion on the cover portion adjacent to the guide and aligned with an IDC element disposed in the IDC block when the access cover is connected to the IDC block.

6. The access cover of claim 3 wherein the back portion comprises a projection configured to engage with an aperture in the IDC block to connect the access cover to the IDC block, wherein at least one of the cover portion, back portion, and projection is manipulable in order to adjust a width of the access cover.

7. The access cover of claim 1 further comprising a removable cap configured to cover the opening in the body.

8. The access cover of claim 7 further comprising a sealant material disposed on the removable cap.

9. The access cover of claim 8 wherein the sealant material is selected from a group consisting of plasticized thermoplastic elastomers, cross-linked silicones, oil-swollen cross-linked polyurethanes or ureas, and oil-swollen polyesters.

10. An insulation displacement connector (IDC) block comprising:

a first housing including a first IDC element and a first testing device slot;

a second housing including a second IDC element and a second testing device slot;

a first access cover movable between a first open position and a first closed position, the first access cover comprising:

a first back portion pivotally connected to the first housing and comprising a first recess configured to receive a first electrical conductor;

a first cover portion adjacent to the first back portion and comprising a first opening configured to receive a testing device capable of breaking the circuit between at least two IDC elements, wherein the first testing device slot is accessible through the first opening when the first access cover is in the first closed position; and a first releasable securing mechanism extending from the first cover portion, wherein the first releasable securing mechanism is configured to engage with the IDC block to releaseably fix the first access cover in the first closed position; and a second access cover movable between a second open position and a second closed position, the second access cover comprising:

a second back portion pivotally connected to the second housing and comprising a second recess configured to receive a second electrical conductor;

a second cover portion adjacent to the second back portion and comprising a second opening configured to receive a testing device capable of breaking the circuit between at least two IDC elements, wherein the second testing device slot is accessible through the second opening when the second access cover is in the second closed position; and a second releasable securing mechanism extending from the second cover portion, wherein the second releasable securing mechanism is configured to engage with the IDC block to releaseably fix the second access cover in the second closed position.

11. The insulation displacement connector block of claim 10 wherein the first back portion of the first access cover further comprises a first projection configured to engage with a first aperture in the IDC block, wherein at least one of the first cover portion, first back portion, and first projection is manipulable in order to adjust a width of the first access cover, and the second back portion of the second access cover further comprising a second projection configured to engage with a second aperture in the IDC block, wherein at least one of the second cover portion, second back portion, and second projection is manipulable in order to adjust a width of the second access cover.

12. The insulation displacement connector block of claim 10 further comprising:

a first guide on the first cover portion of the first access cover aligned to engage the first electrical conductor when the first electrical conductor is introduced into the first recess in the first back portion of the first access cover, the first guide aligning the first electrical conductor with the first IDC element when the first access cover is moved toward the first closed position;

a first protrusion the first cover portion of the first access cover adjacent to the first guide and aligned with a first insulation displacement slot within the first IDC element, the first protrusion urging the first electrical conductor into the first insulation displacement slot within the first IDC element when the first access cover is moved toward the first closed position;

a second guide on the second cover portion of the second access cover aligned to engage the second electrical conductor when the second electrical conductor is introduced into the second recess in the second back portion of the second access cover, the second guide aligning the second electrical conductor with the second IDC element when the second access cover is moved toward the second closed position; and a second protrusion the second cover portion of the second access cover adjacent to the second guide and aligned with a second insulation displacement slot within the second IDC element, the second protrusion urging the second electrical conductor into the second insulation displacement slot within the second IDC element when the second access cover is moved toward the second closed position.

13. The insulation displacement connector block of claim 10 further comprising a first removable cap configured to cover the first opening in the first cover portion; and a second removable cap configured to cover the second opening in the second cover portion.

14. The insulation displacement connector block of claim 13 wherein the first and second removable caps are connected.

15. The insulation displacement connector block of claim 13 further comprising a sealant material disposed on the first and second removable caps.

16. The insulation displacement connector block of claim 15 wherein the sealant material is selected from a group consisting of plasticized thermoplastic elastomers, cross-linked silicones, oil-swollen cross-linked polyurethanes or ureas, and oil-swollen polyesters.

17. The insulation displacement connector block of claim 10 further comprising a sealant material disposed in the first and second housings.

18. The insulation displacement connector block of claim 17 wherein the sealant material is selected from a group consisting of plasticized thermoplastic elastomers, cross-linked silicones, oil-swollen cross-linked polyurethanes or ureas, and oil-swollen polyesters.

* * * * *